US009522407B2

(12) United States Patent
Bettini

(10) Patent No.: US 9,522,407 B2
(45) Date of Patent: Dec. 20, 2016

(54) DISTRIBUTION DEVICE FOR COLORING PRODUCTS

(71) Applicant: COROB S.P.A. CON SOCIO UNICO, San Felice sul Panaro (IT)

(72) Inventor: Marcello Bettini, Cento (IT)

(73) Assignee: COROB S.P.A. CON SOCIO UNICO, San Felice sul Panaro (IT)

( * ) Notice: Subject to any disclaimer, the term of this patent is extended or adjusted under 35 U.S.C. 154(b) by 0 days.

(21) Appl. No.: 14/435,066

(22) PCT Filed: Oct. 10, 2013

(86) PCT No.: PCT/IB2013/002264

§ 371 (c)(1),
(2) Date: Apr. 10, 2015

(87) PCT Pub. No.: WO2014/057341

PCT Pub. Date: Apr. 17, 2014

(65) Prior Publication Data

US 2015/0298156 A1 Oct. 22, 2015

(30) Foreign Application Priority Data

Oct. 11, 2012 (IT) ..... UD2012A0169

(51) Int. Cl.
*B05B 1/30* (2006.01)
*B05B 15/06* (2006.01)
(Continued)

(52) U.S. Cl.
CPC ..... *B05B 15/06* (2013.01); *B01F 13/1055* (2013.01); *B01F 15/0254* (2013.01); *B05B 1/14* (2013.01);
(Continued)

(58) Field of Classification Search
CPC ..... B05B 1/14; B05B 15/065; B05B 1/185; B05B 15/0291; B05B 15/06; Y10S 239/12; B21K 21/08; B01F 13/1055; B01F 15/0254; B01F 2215/005
(Continued)

(56) References Cited

U.S. PATENT DOCUMENTS 5,172,862 A * 12/1992 Heimann ..... B05B 15/0291 239/602
5,405,089 A * 4/1995 Heimann ..... B05B 1/185 239/533.14
(Continued)

FOREIGN PATENT DOCUMENTS

EP 0 283 137 A1 9/1988
IT UD2012A000126 7/2012
(Continued)

OTHER PUBLICATIONS

Search Report for IT UD201200169, dated Jul. 30, 2013.
Search Report for PCT/IB2013/002264, mailed Apr. 4, 2014.
Written Opinion for PCT/IB2013/002264, mailed Apr. 4, 2014.

*Primary Examiner* — Steven J Ganey
(74) *Attorney, Agent, or Firm* — Marshall, Gerstein & Borun LLP

(57) ABSTRACT

Distribution device for coloring products, comprising a collector for dispensing nozzles and corresponding nozzles mounted thereon. The collector comprises a containing body provided with one or more through cavities. In correspondence with one end associated to an external surface the containing body is provided with a positioning element. The containing body is provided with a seating, inside the external surface, disposed at the end of each of the through cavities, defining a wider portion with respect to the cross section of the corresponding through cavity.

7 Claims, 1 Drawing Sheet

(51) Int. Cl.

| | |
|---|---|
| ***B21K 21/08*** | (2006.01) |
| ***B05B 15/02*** | (2006.01) |
| ***B05B 1/18*** | (2006.01) |
| ***B05B 1/14*** | (2006.01) |
| ***B01F 13/10*** | (2006.01) |
| ***B01F 15/02*** | (2006.01) |

(52) U.S. Cl.
CPC ..... *B05B 1/185* (2013.01); *B05B 15/0291* (2013.01); *B05B 15/065* (2013.01); *B21K 21/08* (2013.01); *B01F 2215/005* (2013.01); *Y10S 239/12* (2013.01)

(58) Field of Classification Search
USPC ..... 239/548, 558, 559, 533.13, 533.14, 602,239/DIG. 12
See application file for complete search history.

(56) References Cited

U.S. PATENT DOCUMENTS

| | | | | |
|---|---|---|---|---|
| 5,730,363 | A | 3/1998 | Kress | |
| 6,463,658 | B1 * | 10/2002 | Larsson | B05B 1/185 29/890.142 |
| 7,721,979 | B2 * | 5/2010 | Mazzola | B05B 1/185 239/533.14 |
| 2005/0092386 | A1 | 5/2005 | Kaufhold et al. | |
| 2009/0230149 | A1 | 9/2009 | Smeller et al. | |
| 2012/0111887 | A1 | 5/2012 | Smeller et al. | |

FOREIGN PATENT DOCUMENTS

| | | | |
|---|---|---|---|
| WO | WO-2011/161532 | A1 | 12/2011 |
| WO | WO-2011/163227 | A1 | 12/2011 |
| WO | WO-2012/038802 | A1 | 3/2012 |

* cited by examiner

DISTRIBUTION DEVICE FOR COLORING PRODUCTS

FIELD OF THE INVENTION

The present invention concerns a distribution device for coloring products, comprising a collector for dispensing nozzles and the corresponding nozzles mounted thereon.

The distribution device is applied in all the fields of the state of the art in which it is necessary to guide and keep one or more dispensing nozzles of any type of product, whether it is solid or fluid, accurately positioned. In particular, but not only, the device according to the present invention is applied in dispensing machines, also called dispensers, able to prepare and distribute coloring products, such as varnishes, paints or similar.

BACKGROUND OF THE INVENTION

A distribution device for coloring products is known, having a collector for dispensing nozzles which comprises a containing body provided with a plurality of through holes, in each of which a dispensing nozzle is suitable to be inserted, which in correspondence to one of its delivery ends a pair of flexible positioning tongues of the snap-in type is provided.

In this known collector, when the corresponding dispensing nozzle is inserted in the collector, the two flexible positioning tongues cooperate directly with the external surface of the collector that faces downward, that is, toward the delivery side, which is normally flat and smooth.

This known collector however has the disadvantage that it does not guarantee a precise positioning of the dispensing nozzles, because the corresponding flexible tongues are not guided laterally and can bend to a greater or lesser extent, depending on the axial thrust which is applied on the dispensing nozzle.

Document U.S. Pat. No. 5,730,363 A describes a water delivery head for a shower, which comprises a first holed plate and a second plate in which a plurality of channels for the delivery of jets of water is made.

EP 283.137 A describes a collector for nozzles comprising a plate with a plurality of holes in each of which a corresponding nozzle is inserted.

U.S. 2005/092386 A1, WO 2011/163227 A1, U.S. 2009/230149 A1 and U.S. 2012/111887 A1 also concern in general holed plates to house and support corresponding distribution elements of fluid products.

Purpose of the present invention is to manufacture a distribution device for coloring products comprising a collector for dispensing nozzles which allows the latter to be positioned with precision, in a simple, reliable and inexpensive way.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

The new and original technical solution, which achieves said purpose, with immediate, surprising and unforeseeable advantages, yet still contains the production costs, provides to manufacture a collector for dispensing nozzles which comprises a containing body provided with one or more through cavities, each suitable to contain a dispensing nozzle, which in correspondence to one of its ends associated, during use, to an external surface of the containing body of the collector, is provided with at least a positioning element of the snap-in type.

In accordance with a main characteristic of the present invention, the containing body is provided with a seating, disposed inside the external surface at the end of each of the through cavities, defining a wider portion with respect to the cross section of the corresponding through cavity, and in which the positioning element of the corresponding dispensing nozzle is suitable to be housed.

In a preferential form of embodiment of the present invention, the seating comprises a notch with a transverse size greater than that of the corresponding through cavity.

Moreover, in accordance with a secondary feature of the present invention, when the pair of snap-in positioning elements comprises two flexible tongues, the transverse size of the notch is substantially equal to the maximum bulk of the two flexible tongues when they are in the extended position.

With the present invention, since the housing seating, or notch, of the positioning tongues is disposed inside with respect to the external surface of the containing body of the collector, a precise positioning of the dispensing nozzles is guaranteed, since the corresponding tongues are guided laterally and cannot bend as a function of the axial thrust which is applied on the dispensing nozzle.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF ONE FORM OF EMBODIMENT

Figure 1:
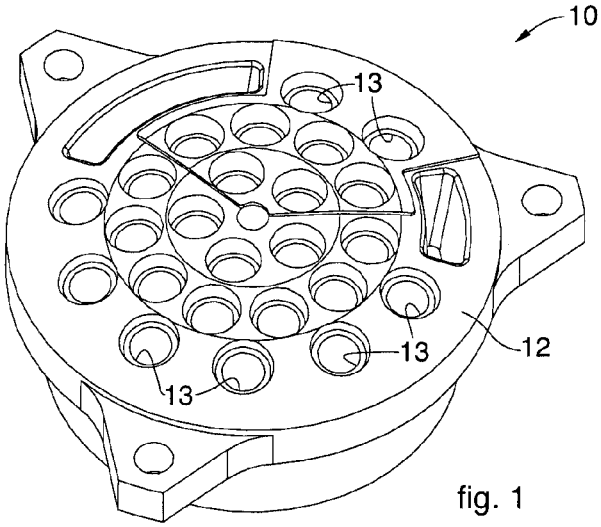
FIG. 1 is a perspective view of a collector according to the present invention.
Figure 2:
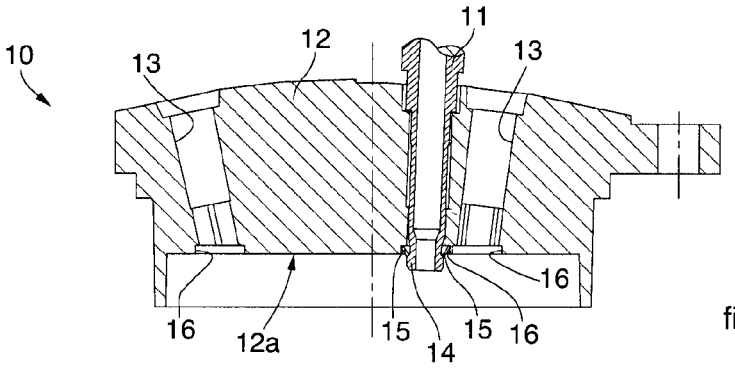
FIG. 2 is a cross section of the collector in FIG. 1.

With reference to FIGS. 1 and 2, a distribution device for coloring products comprises a collector 10 suitable to support a plurality of dispensing nozzles 11 of the known type, for example suitable to dispense coloring products, such as liquid pigments. The collector 10 is suitable to be mounted on a dispensing machine of the known type, for example of the type described in the international patent application WO-A-2011/161532, or in the Italian patent application for industrial inventions UD2012A000126, both in the name of the Applicant.

The collector 10 comprises a containing body 12 which is substantially disc shaped, made, for example, of polyoxymethylene (POM). The containing body 12 is passed through by a plurality of through cavities 13, of which there are twenty-four in the example given here, but there could be more or fewer, since their number is not an important feature of the present invention. Indeed, the body 12 could have just one through cavity 13. In each through cavity 13 a single dispensing nozzle 11 is suitable to be housed.

In this case, each dispensing nozzle 11 has a cylindrical tubular shape, is made of plastic material, for example DELRIN© 500, or of metal, for example stainless steel, and is provided at one of its dispensing ends 14 with a pair of flexible tongues 15, disposed diametrically opposite and which act as positioning elements. During use, when the nozzles 11 are inserted in the respective through cavities 13, the dispensing end 14 exits with respect to an external surface 12*a* of the body 12 normally facing downward.

Similarly, each through cavity 13 also has a substantially cylindrical shape and sizes mating with those of the dispensing nozzles 11, in order to house, with precision, one of these inside it. Each of the two flexible tongues 15 is elastically mobile between an extended position and a compressed position.

Figure 3:
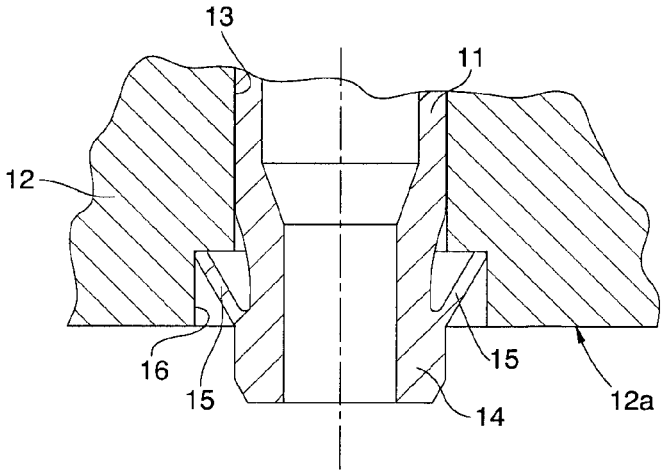
FIG. 3 is an enlarged detail of FIG. 2.

At the external end of each through cavity 13, but in an internal position with respect to the external surface 12*a*, a seating 16 is made in which the two flexible tongues 15 of a corresponding dispensing nozzle 11 (FIG. 3) are suitable to be housed. Each seating 16 has the shape of a notch, cylindrical or with a truncated cone shape, substantially centered with respect to the corresponding through cavity 13 and having a transverse size greater than that of the latter. For example, if the diameter of the through cavity 13 is about 5 mm, the seating 16 has a transverse size of about 6 mm and a depth of about 1 mm.

Therefore, when a dispensing nozzle 11 is inserted in a corresponding through cavity 13, the flexible tongues 15 of the dispensing nozzle 11 snap-in elastically inside the seating 16, so that the bottom wall of the latter will define the axial position of the delivery nozzle 11, while the lateral wall of the seating 16 will define the field of action of the flexible tongues 15, limiting stress and danger of breakage thereof. In this way, each dispensing nozzle 11 will be perfectly centered and positioned axially with respect to the containing body 12 of the collector 10.

It is clear that modifications and/or additions of parts may be made to the distribution device for coloring products as described heretofore, without departing from the field and scope of the present invention.

It is also clear that, although the present invention has been described with reference to some specific examples, a person of skill in the art shall certainly be able to achieve many other equivalent forms of collectors for dispensing nozzles, having the characteristics as set forth in the claims and hence all coming within the field of protection defined thereby.

The invention claimed is:

1. Distribution device for coloring products, comprising a collector for dispensing nozzles and said corresponding dispensing nozzles mounted thereon, wherein said collector comprises a containing body provided with one or more through cavities, each of said through cavities suitable to contain one of said dispensing nozzles, which, in correspondence with one of its dispensing ends associated, during use, to an external surface of said containing body, is provided with at least one positioning element of the snap-in type, wherein said containing body is provided with a seating, inside said external surface, disposed at the end of each of said through cavities, defining a wider portion with respect to the cross section of the corresponding through cavity, and in which said snap-in positioning element of the corresponding dispensing nozzle is suitable to be housed, wherein each of said dispensing nozzles has a tubular shape having a determinate transverse size and each of said through cavities comprises a hole with shape and transverse size mating with those of said dispensing nozzles, wherein said seating comprises a notch having a transverse size greater than that of the corresponding through cavity, and wherein each of said dispensing nozzles has a substantially cylindrical tubular shape and is provided at said dispensing end with a pair of snap-in positioning elements disposed in diametrically opposite positions, wherein each of said through cavities comprises a substantially cylindrical hole, and wherein said notch has a substantially cylindrical or truncated cone shape, so as to accommodate said pair of positioning elements.

2. Distribution device for coloring products as in claim 1, wherein said notch is substantially centered with respect to the corresponding through cavity.

3. Distribution device for coloring products as in claim 2, wherein each of said positioning elements comprises a flexible tongue, elastically movable between an extended position and a compressed position, wherein the transverse size of said notch is substantially equal to the maximum bulk of said pair of positioning elements in the extended position.

4. Distribution device for coloring products as in claim 1, wherein each of said positioning elements comprises a flexible tongue, elastically movable between an extended position and a compressed position, wherein the transverse size of said notch is substantially equal to the maximum bulk of said pair of positioning elements in the extended position.

5. Distribution device for coloring products as in claim 4, wherein said maximum bulk of said pair of positioning elements in the extended position and said transverse size of said notch are each about 6 mm.

6. Distribution device for coloring products as in claim 5, wherein the depth of said notch is about 1 mm.

7. Distribution device for coloring products as in claim 1, wherein said notch is substantially centered with respect to the corresponding through cavity.

* * * * *